US011879189B2

(12) United States Patent
Ball

(10) Patent No.: US 11,879,189 B2
(45) Date of Patent: Jan. 23, 2024

(54) VISUAL BARRIER WINDSCREEN, INCLUDING KNITTED INTERLOCKING CHAINS FORMING WIND PASSAGE HOLES, AND ASSOCIATED METHODS

(71) Applicant: Ball Fabrics, Inc., Deland, FL (US)

(72) Inventor: Larry Ball, Deland, FL (US)

(73) Assignee: BALL FABRICS, INC., Deland, FL (US)

( * ) Notice: Subject to any disclaimer, the term of this patent is extended or adjusted under 35 U.S.C. 154(b) by 366 days.

(21) Appl. No.: 17/224,552

(22) Filed: Apr. 7, 2021

(65) Prior Publication Data

US 2022/0325555 A1 Oct. 13, 2022

(51) Int. Cl.

| | |
|---|---|
| ***D04B 1/22*** | (2006.01) |
| ***E04H 17/16*** | (2006.01) |
| ***E04H 17/06*** | (2006.01) |

(52) U.S. Cl.

CPC ..... *D04B 1/22* (2013.01); *E04H 17/063* (2013.01); *E04H 17/164* (2021.01); *D10B 2321/0211* (2013.01); *D10B 2505/18* (2013.01)

(58) Field of Classification Search

CPC ..... D04B 1/22; D04B 21/10; D04B 21/12; D04B 21/202; E04H 17/16; E04H 17/1602; A47H 23/00

See application file for complete search history.

(56) References Cited

U.S. PATENT DOCUMENTS

| | | | | |
|---|---|---|---|---|
| 2,371,039 A * | 3/1945 | Fischel | A47H 23/08 | 160/390 |
| 3,413,825 A * | 12/1968 | Winch | D04B 21/10 | 66/193 |
| 4,377,195 A * | 3/1983 | Weil | A47H 23/08 | 160/237 |
| 4,748,078 A * | 5/1988 | Doi | D04B 21/08 | 66/169 A |
| 5,392,832 A * | 2/1995 | Colson | E06B 9/262 | 160/176.1 V |
| 5,596,888 A * | 1/1997 | McLarty, III | D04B 21/18 | 66/195 |
| 5,732,573 A * | 3/1998 | Sexton | D04B 21/10 | 66/195 |
| 6,141,993 A * | 11/2000 | Whitbeck | A01G 20/10 | 66/170 |
| 6,305,196 B1 * | 10/2001 | Takeshita | D04B 21/10 | 66/203 |

(Continued)

FOREIGN PATENT DOCUMENTS

WO WO-2015122783 A1 * 8/2015 ..... A01G 13/02

*Primary Examiner* — Danny Worrell

(57) ABSTRACT

A visual barrier windscreen includes a first series of monofilament threads formed in pillar stitches extending in a warp direction and a second series of monofilament threads formed in zigzag stitches extending in a first weft direction relative to the pillar stitches and binding adjacent pillar stitches. A third series of monofilament threads may be formed in zig-zag stitches extending in a second weft direction, opposite to the first weft direction, and also binding adjacent pillar stitches. A pattern of hexagonal wind-passage holes may be formed by cooperation of the pillar stitches and zig-zag stitches. At least a 75-80% visual block may be attained with the cooperation of the pillar stitches and zig-zag stitches.

17 Claims, 3 Drawing Sheets

(56) References Cited

U.S. PATENT DOCUMENTS

| | | | | |
|---|---|---|---|---|
| 6,630,414 | B1 * | 10/2003 | Matsumoto | A47C 31/006 428/116 |
| 6,688,143 | B2 * | 2/2004 | Williams | D04B 21/16 442/310 |
| 6,745,599 | B2 * | 6/2004 | Bailey | D04B 21/16 442/305 |
| 7,415,845 | B1 * | 8/2008 | Graichen | D04B 21/06 66/170 |
| 8,056,373 | B2 * | 11/2011 | Kazuma | E06B 9/266 66/196 |
| 10,604,874 | B2 * | 3/2020 | Karatzis | B01F 35/71825 |
| 10,844,527 | B2 * | 11/2020 | Nasarczyk | D04B 21/16 |
| 2002/0157429 | A1 * | 10/2002 | Matsumoto | D04B 21/10 66/195 |
| 2003/0106347 | A1 * | 6/2003 | Kost | D04B 21/18 66/195 |
| 2004/0035154 | A1 * | 2/2004 | Bailey | D04B 21/16 66/195 |
| 2016/0353677 | A1 * | 12/2016 | Toye | A01G 13/0206 |
| 2019/0338586 | A1 * | 11/2019 | Swiszcz | E06B 9/52 |
| 2021/0393390 | A1 * | 12/2021 | Felix | D04B 21/12 |

* cited by examiner

VISUAL BARRIER WINDSCREEN, INCLUDING KNITTED INTERLOCKING CHAINS FORMING WIND PASSAGE HOLES, AND ASSOCIATED METHODS

FIELD OF THE INVENTION

The present invention relates in general to the field of barriers, and in particular to windscreens installed on fences for providing a visual barrier and wind block, and associated methods.

BACKGROUND OF THE INVENTION

In general, windscreens are mesh fabric installed on fences used for visual barriers and wind block. Typical applications are athletic fields, tennis courts, as well as other fences where there is a desire to "dress up" the fence as well as add some visual barrier, Historically, the more common fabrics that have been used for windscreens are vinyl coated polyester mesh and woven polypropylene. There have also been some knitted polyethylene fabrics that have been used. The standard desired visual block for these products has been around 80%. The knitted polyethylene products are stretchy and may not look good once installed on the fence due to the sagging caused by this stretchiness.

Tape is a thin sheet of polyethylene that is slit into very narrow widths and used as a type of yarn in the polyethylene knitting industry.

A windscreen that lasts longer may not address a problem that plagues all windscreen owners. This problem is "wind maintenance" and "wind damage". Windscreen owners have a problem with windscreens blowing off the fence in medium to high winds. This increases costs to the owner when the fasteners break, the screen flaps in the wind, and maintenance personnel must get those fasteners replaced as soon as possible. This adds to the maintenance costs for facilities that have windscreens and may even prohibit windscreens from being installed at certain locations.

If the owner does not replace fasteners and re-attach the windscreen to the fence, and the windscreen is left flapping in the wind for any length of time, the windscreen will get damaged from flapping and banging against the fence. This is called wind whipping and is a common problem seen at almost all facilities that have windscreens.

Another problem to be considered when evaluating wind maintenance, is that there may be occasions where fences are blown down in high wind events because of the added load that the windscreen puts on the fence.

In view of the above discussion, as an alternative to the typical woven products, there may be a desire for a knitted polyethylene fabric that is knitted with increased stability to reduce or eliminate any stretchiness, improved performance against UV degradation, and increased durability.

This background section is intended to introduce the reader to various aspects of typical technology that may be related to various aspects or embodiments of the present invention, which are described and/or claimed below. This discussion is believed to be useful in providing the reader with background information to facilitate a better understanding of the various aspects and embodiments of the present invention. Accordingly, it should be understood that these statements are to be read in light of, and not as admissions of, the prior art.

SUMMARY OF THE INVENTION

It is an object of the present embodiments to provide a system, device and method for providing a visual barrier windscreen with increased air permeability along with the desired visual blocking features and improved durability.

This and other objects, advantages and features in accordance with the present embodiments may be provided by a visual barrier windscreen including a first series of monofilament threads formed in pillar stitches extending in a warp direction, and a second series of monofilament threads formed in zigzag stitches extending in a first weft direction relative to the pillar stitches and binding adjacent pillar stitches. A third series of monofilament threads is formed in zigzag stitches extending in a second weft direction opposite to the first weft direction and also binding adjacent pillar stitches. A pattern of hexagonal wind-passage holes are formed by a cooperation of the pillar stitches and zig-zag stitches. At least a 75-80% visual block is attained with the cooperation of the pillar stitches and zig-zag stitches.

Additionally, and/or alternatively, the first series of monofilament threads may comprise high density polyethylene of approximately 750 denier. And, the second and third series of monofilament threads may comprise high density polyethylene of approximately 450 denier.

Additionally, and/or alternatively, the first series of monofilament threads are formed in sixteen pillar stitches per inch. The second and third series of monofilament threads may be formed in closed zig-zag stitches extending across an equivalent of five needle gaps in the first and second weft directions respectively.

Additionally, and/or alternatively, a rating of 755+ cfm/ft$^2$ according to an ASTM D737 air permeability test, may be achieved with the cooperation of the pillar stitches and zig-zag stitches.

Another embodiment is directed to a visual barrier windscreen including a first series of monofilament threads formed in pillar stitches extending in a longitudinal direction, a second series of monofilament threads formed in zig-zag stitches binding adjacent pillar stitches, and a third series of monofilament threads formed in zig-zag stitches binding adjacent pillar stitches. A pattern of wind-passage holes are formed by a cooperation of the pillar stitches and zig-zag stitches.

Additionally, and/or alternatively, the first series of monofilament threads comprise high density polyethylene of approximately 750 denier. Also, the second and third series of monofilament threads may comprise high density polyethylene of approximately 450 denier.

Additionally, and/or alternatively, the first series of monofilament threads are formed in sixteen pillar stitches per inch. Also, the second and third series of monofilament threads may be formed in closed zig-zag stitches extending across an equivalent of five needle gaps in the first and second weft directions respectively.

Additionally, and/or alternatively, at least a 75-80% visual block is attained with the cooperation of the pillar stitches and zig-zag stitches.

Additionally, and/or alternatively, the wind-passage holes may comprise hexagonal wind passage holes formed by the cooperation of the pillar stitches and zig-zag stitches, and wherein a rating of 755+ cfm/ft$^2$ according to an ASTM D737 air permeability test, is achieved with the cooperation of the pillar stitches and zig-zag stitches.

Another embodiment is directed to a method of making a visual barrier windscreen, the method comprising: forming a first series of monofilament threads in pillar stitches extending in a longitudinal direction; forming a second series of monofilament threads in zig-zag stitches binding adjacent pillar stitches; and forming a third series of monofilament threads in zig-zag stitches binding adjacent pillar stitches; wherein a pattern of wind-passage holes are formed by a cooperation of the pillar stitches and zig-zag stitches.

Additionally, and/or alternatively, the first series of monofilament threads are formed in pillar stitches extending in a warp direction, the second series of monofilament threads are formed in zig-zag stitches extending in a first weft direction relative to the pillar stitches, and the third series of monofilament threads are formed in zig-zag stitches extending in a second weft direction opposite to the first weft direction.

Additionally, and/or alternatively, the first series of monofilament threads comprise high density polyethylene of approximately 750 denier, and the second and third series of monofilament threads comprise high density polyethylene of approximately 450 denier.

Additionally, and/or alternatively, the first series of monofilament threads are formed in sixteen pillar stitches per inch. Also, the second and third series of monofilament threads may be formed in closed zig-zag stitches extending across an equivalent of five needle gaps in the first and second weft directions respectively.

Additionally, and/or alternatively, at least a 75-80% visual block is attained with the cooperation of the pillar stitches and zig-zag stitches.

Additionally, and/or alternatively, the wind-passage holes comprise hexagonal wind passage holes formed by the cooperation of the pillar stitches and zig-zag stitches, and a rating of 755+ cfm/ft$^2$ (cubic feet per minute, per square foot) according to an ASTM D737 air permeability test, is achieved with the cooperation of the pillar stitches and zig-zag stitches. Air permeability is defined as the rate of airflow passing perpendicularly through a known area under a prescribed air pressure differential between the two surfaces of a material.

DETAILED DESCRIPTION OF THE PREFERRED EMBODIMENTS

Figure 1:
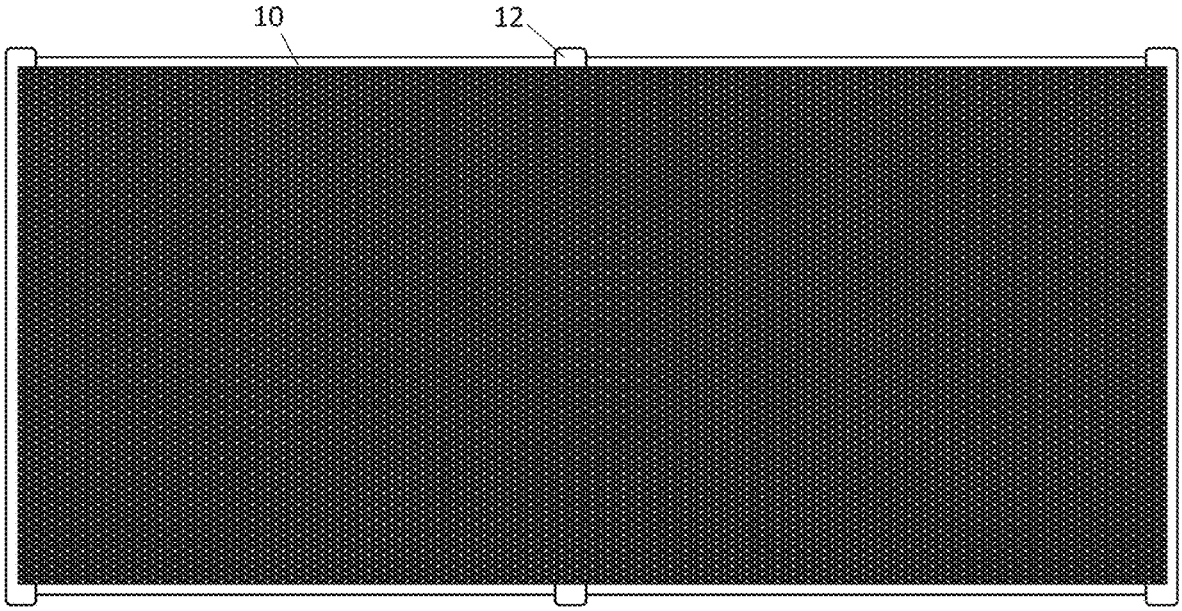
FIG. 1 is a perspective view illustrating an embodiment of a visual barrier windscreen in accordance with features of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Warp knitting is a family of knitting methods in which the yarn zig-zags along the length of the fabric; i.e., following adjacent columns, or wales, of knitting, rather than a single row, or course. For comparison, knitting across the width of the fabric is called weft knitting, Since warp knitting requires that the number of separate strands of yarn, or ends, equals the number of stitches in a row, warp knitting is almost always done by machine rather than by hand.

The concept of 'air permeability' is widely used in the textile industry to interpret the intrinsic characteristics of fabric. Several existing standards can be used for air permeability evaluation with different testing conditions. Air permeability is significantly influenced by a fabric's material and structural properties, such as shape and value of the pores of the fabric and yarn, which in turn are dependent on the structural parameters of the fabric, such as fabric weave, the raw material of the yarns, the set of yarns and others.

Construction factors and finishing techniques can also have an effect upon air permeability by causing a change in the length of air flow paths through a fabric. Fabrics with different surface textures on either side can have a different air permeability depending upon the direction of air flow.

ASTM defined the term air permeability as the rate of air flow passing perpendicularly through a known area under a prescribed air pressure differential between the two surfaces of a material. It is generally expressed in SI units as cm/s/cm$^2$ or in inch-pound units as cfm/ft$^2$. The term air permeability is also closely related to the term wind resistance performance which evaluates the performance of parachutes, sail cloth, windscreens and industrial filter fabrics.

ASTM D737 is an air permeability test of textile fabrics. The rate of air flow passing perpendicularly through a known area of fabric is adjusted to obtain a prescribed air pressure differential between the two fabric surfaces. From this rate of air flow, the air permeability of the fabric is determined.

Referring to FIGS. 1-5, an example embodiment including a system, device and method according to features of the present invention is described and illustrated. The example embodiments are best understood from the following detailed description when read with the accompanying drawing figures. Dimensions may be arbitrarily increased or decreased for clarity of discussion.

FIG. 1 is a perspective view illustrating an embodiment of a visual barrier windscreen 10 in accordance with features of the present invention. The visual barrier windscreen 10 is illustrated as being installed on a fence section 12 and may be used for visual barriers and wind block. Typical applications are athletic fields, tennis courts, as well as other fences that require some visual barrier and/or wind block.

Figure 2:
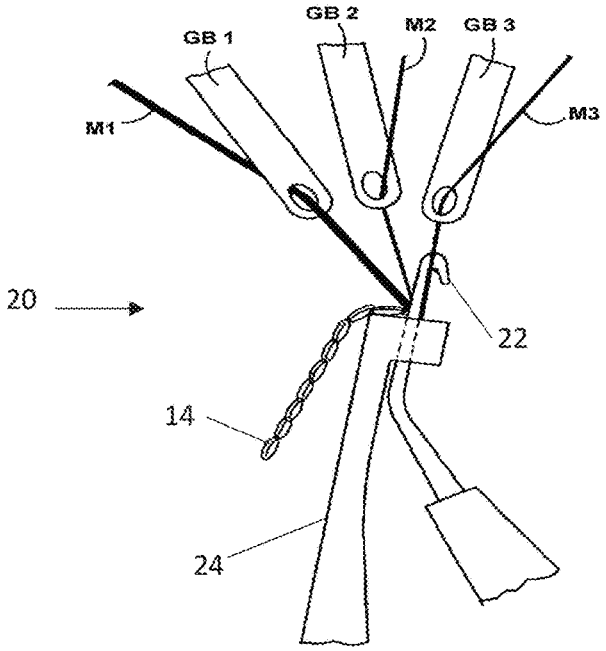
FIG. 2 is a side view illustrating a portion of an example of a warp knitting machine, used to make the visual barrier windscreen of FIG. 1, and including latch needles, a trick plate, and three guide bars.

FIG. 2 is a side view illustrating a portion of an example of a warp knitting machine 20, used to make the visual barrier windscreen 10, and including latch needles 22, a trick plate 24, and three guide bars GB1, GB2 and GB3. For example, the warp knitting machine 20 may be a 9-gauge three bar Raschel-type warp knitting machine.

As may be appreciated by those skilled in the art, the Raschel machine is a machine that relies on warp knits. As such, the warps are laid diagonally to form the fabric. Each warp is then twisted, locked with a loop from the adjacent warp and then shifted back, by one warp, to the prior column of knitting. The needles in the machine move in a ground steel plate. This plate is known as a trick plate. It limits the top level of the loops, known as the verge. The loops are limited by the pull of the yarn and sinkers that are located between the needles. The machine has locking belts that are fixed in location relative to a plane that is perpendicular to the shaking motion, the motion usually referred to in the industry as shogging. In addition, the yarn laying-in comb, and at least one guide bar for the stitch yarns, is movable not only in a plane perpendicular to the shaking direction but also in a plane parallel to it. The motion of the laying-in comb allows large under laps without the associated risk of faulty lapping of the yarns.

Coarser yarns are generally used for Raschel knitting. In a knitting cycle, the needles start at the lowest point, when the preceding loop has just been cast off, and the new loop joins the needle hook to the fabric. The needles rise, while the new loop opens the latches and ends up on the shank below the latch. The guide bars then swing through the needles and the front bar moves one needle space sideways. When the guide bar swings back to the front of the machine, the front bar has laid the thread on the hooks. The needles fall, the earlier loops close the latch to trap the new loops, and the old loops are cast off. Raschel knits, made in a variety of forms, are usually more open in construction and coarser in texture than are other warp knits.

For example, in the warp knitting machine 20, the first guide bar GB1 may carry a series of guide needles, the second guide bar GB2 may carry a series of guide needles, and the third guide bar GB3 may carry a series of guide needles. The latch needles 22 of the knitting machine 20 may be spaced ⅕th of an inch apart. Hence, the needle gaps may be ⅕th of an inch. A knitted fabric 14 made on the knitting machine 20 includes a series of monofilament threads M1 each of which passes through the eye of a corresponding one of the guide needles of the first guide bar GB1, a second series of monofilament threads M2 each of which passes through the eye of a corresponding one of the guide needles of the second guide bar GB2, and a third series of monofilament threads M3 each of which passes through the eye of a corresponding one of the guide needles of the third guide bar GB3.

In various embodiments, the threads M1 are preferably 750 Denier monofilament threads of high density polyethylene. The threads M2 and M3 are preferably each a 450 Denier monofilament threads of high density polyethylene. With knitted polyethylene including threads that are produced with UV inhibitors, the resulting fabric may last a relatively long time compared to standard woven polyester and woven polypropylene.

Figure 3A:
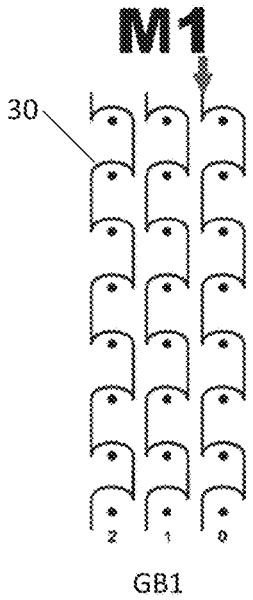
FIGS. 3A-3C are schematic views illustrating example stitch patterns of the respective monofilament threads of the visual barrier windscreen of FIG. 1.
Figure 3B:
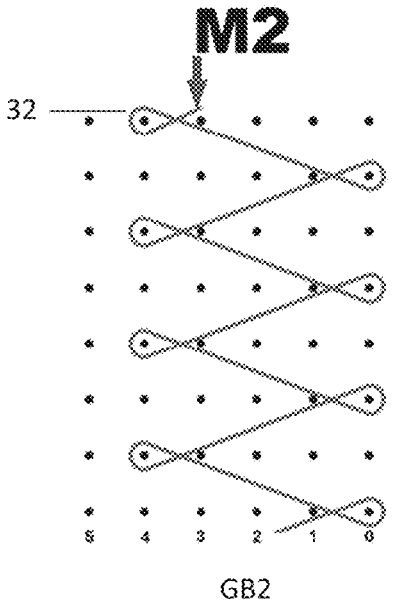
Figure 3C:
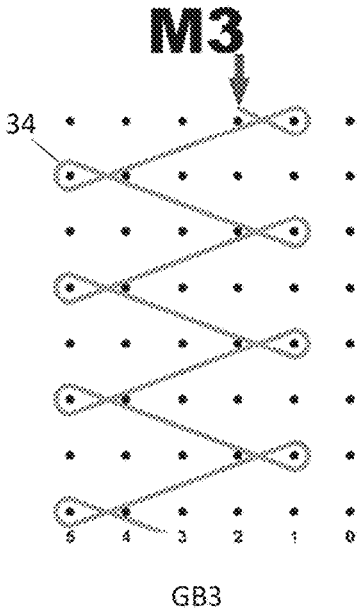

FIGS. 3A-3C are schematic views illustrating example stitch patterns of the respective monofilament threads of the visual barrier 10. As can be seen in FIG. 3A, each of the monofilament threads M1 are threaded in first guide bar GB1 and knitted to form a pillar stitch 30 which gives the fabric strength in the longitudinal or warp direction. The monofilament threads M1 are knitted, for example, with 16 pillar stitches per inch of fabric to provide the fabric 14 with the desired density and coverage. As shown in FIG. 3B, the monofilament threads M2 are threaded in the second guide bar GB2 and are knitted in a zig-zag fashion to form a binding between adjacent pillar stitches 30, As can be seen in FIG. 3, the monofilament threads M2 are threaded in alternate guides keeping one guide empty and one guide full. The monofilament threads M2 are knitted in a closed stitch 32 and traverse the equivalent of five needle gaps in a weft direction per machine cycle. As shown in FIG. 3C, the monofilament thread M3 is threaded in the third guide bar GB3 and knitted in a zigzag pattern to form a binding between adjacent pillar stitches 30. As can be seen in threading diagram from FIG. 4, the guides of GB3 are alternately threaded, keeping one guide empty and one guide full. Further the lapping movement of GB3 is opposite to the direction of GB2, as can be seen in FIG. 3C. The monofilament threads M3 are knitted in a closed stitch 34 and traverse the equivalent of five needle gaps in a weft direction per machine cycle. The use of monofilament threads M2 and M3 for the weft, as well as the knitting pattern, provides excellent stability to the fabric 14 in the warp direction.

Figure 4:
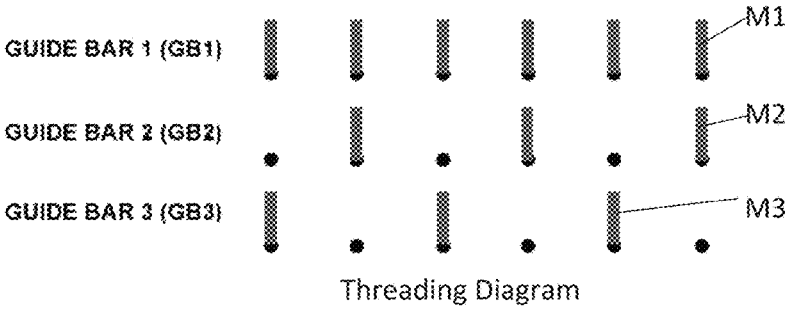
FIG. 4 is an example threading diagram for guide bars used in the warp knitting machine of FIG. 2.

FIG. 4 is an example threading diagram for guide bars used in the warp knitting machine 20. It should be noted, as illustrated in threading diagram FIG. 4, the threading of guide bars GB2 and GB3 is such that, in the parallel guides of GB2 and GB3, one guide is threaded and the parallel guide in the other guide bar is empty. This threading structure facilitates the formation of desired knit patterns (e.g., hexagonal knit patterns) when the guide bars GB2 and GB3 move in opposite directions.

Figure 5:
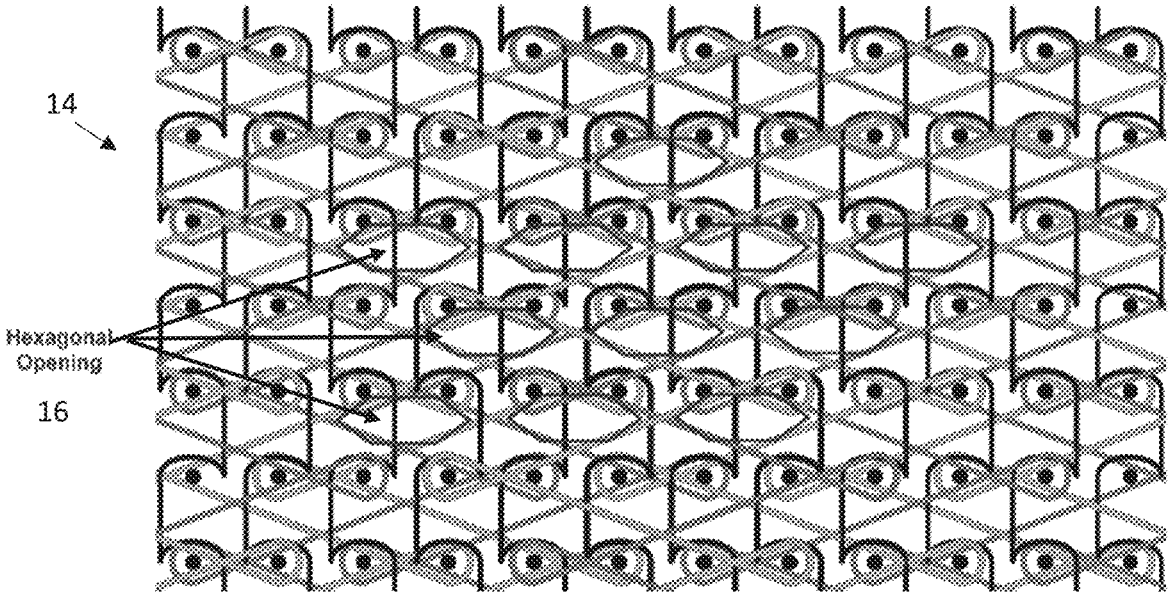
FIG. 5 is a stitching diagram illustrating an example of hexagonal wind passage holes formed by the cooperation of the pillar stitches and zigzag stitches of FIGS. 3A-3B.

FIG. 5 is a stitching diagram illustrating an example of the fabric 14 of the visual barrier windscreen 10 including wind passage holes 16 (e.g., hexagonal wind passage holes) formed by the cooperation of the pillar stitches 30 and zig-zag closed stitches 32, 34 of FIGS. 3A-3B. Due to the knit configuration of the knitted fabric 14, a hexagonal wind passage hole 16 is created by the interaction of monofilament threads M1, M2 and M3. This hexagonal wind passage hole 16 is created between each knot of the pillar stitch 30 and the adjacent pillar stitch 30. It is because of these hexagonal wind passage holes 16 that the fabric 14 allows minimum resistance to the wind as the hexagonal wind passage holes 14 allow a clear passage of the wind. Further, the use of all monofilament threads, which have a circular cross section, also provides minimum resistance to wind.

The tight knit configuration of the fabric 14 with opposing weft forces provides the fabric additional stability and reduced elongation. The fabric 14 may be constructed using a 9-gauge machine. The use of 9-gauge machine for knitting may be preferable, but 6-gauge and 12-gauge machines are also contemplated. A 6-gauge machine has 6 needles per inch, 9-gauge machine has 9 needles per inch and 12-gauge machine has 12 needles per inch.

Using a 6-gauge machine, the knitted fabric 14 may have reduced fabric density and coverage and offer reduced wind resistance. The 12-gauge machine fabric 14 may result in more resistance to wind but an increased density and hence more coverage and more visual blockage. However, to achieve the desired results for the application, the 9-gauge fabric construction may be preferred. The results of the 9-gauge knitted fabric 14 may offer the most balanced combination of minimal wind resistance and favorable coverage.

In an embodiment of the knitted fabric 14, the fabric 14 was made on a 9-gauge machine using monofilament threads M1, M2, M3 that are 450 denier each, and are UV stabilized High Density Polyethylene. This embodiment of the fabric 14 may achieve a coverage, or visual block, of 75-76% at 340 grams/$m^2$.

To increase the visual block from the fabric 14, e.g., to a 80% coverage, an embodiment of the knitted fabric 14 was made on a 9-gauge machine using monofilament threads M1 at 750 Denier, and monofilament threads M2, M3 at 450 denier each. By increasing the diameter of the circular cross section of the monofilament thread M1, the fabric coverage improved and the knitted fabric 14 also achieved an increased warp strength. With this development, the fabric was able to achieve a coverage of 80% in black color with a fabric weight of 410 grams/$m^2$.

In view of the above discussion, the windscreen knit pattern of the present embodiments achieves the desired visual block (e.g., 75-80%) and addresses the wind maintenance issue of the prior art by allowing the wind to pass through with significantly reduced load, thereby solving a problem that nearly all windscreen owners face. The embodiments may use 100% monofilament and eliminate any tape. Thus, the embodiments include a knit pattern that allows for a 75-80% visual block, but also significantly reduces wind loads on the screen and the fence while using 100% monofilament yarns and keeping the costs down. In various embodiments, the hexagonal knit pattern is effective and creates a stable product, for example, with minimal stretch. During field tests, the windscreen according to the present embodiments handled high winds better than prior windscreens.

A fabric testing lab conducted an air permeability test which showed the amount of air that flows through the windscreen (ASTM D737). The present windscreen was tested against an industry popular windscreen. The existing product was a vinyl coated polyester product with a 78% visual block. So, the test included an example embodiment of the present windscreen at 78% visual block using the knitted polyethylene with the hexagonal knit pattern against a 78% visual block vinyl coated polyester product. The existing product tested at 444 cfm/$ft^2$. The windscreen of the present embodiments tested at 755+ cfm/$ft^2$. The lab used a plus (+) symbol because their machine could not record over 755 cfm/$ft^2$. This test shows that the windscreen of the present embodiments measured against a similar visual block product allowed 41% more wind to pass through. Accordingly, this will reduce the load on a fence by the same percentage, as well as the load on the fasteners.

In addition to the high air permeability, there are additional advantages with the present embodiments due to the knit pattern (e.g., hexagonal). These individual tiny hexagonal patterns are knitted together in concentric, interlocking "chains" and create a slightly springy characteristic. This unique hexagonal pattern allows for very minimal but important "give" in the fabric. This allows for the fabric to stretch to handle a high wind gust and then return to its original shape. This slight stretch acts as a kind of shock absorber letting the wind to pass through without breaking the fasteners. So, this knit pattern is advantageous because it allows for the desired visual block while allowing more wind to pass through than prior windscreen designs, while also allowing for the shock absorber affect. These advantages address the wind maintenance problems of the prior art discussed above.

Furthermore, by changing the yarn size, an 80% visual block may be achieved. The same air permeability test (ASTM D737) was run on the 80% visual block embodiment and the results were still at 755+ cfm/$ft^2$. The windscreen embodiments of the present invention alleviate the wind maintenance issues of the prior art, as well reduce loads on fences by significant amounts. The present structure provides a stable windscreen with at least a 75-80% visual block that can save thousands of dollars in operational costs each year, and additionally can prevent potential fence damage in high wind events.

The present invention may have also been described, at least in part, ire terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

The above description provides specific details, such as material types and processing conditions to provide a thorough description of example embodiments. However, a person of ordinary skill in the art would understand that the embodiments may be practiced without using these specific details.

Some of the illustrative aspects of the present invention may be advantageous in solving the problems herein described and other problems not discussed which are discoverable by a skilled artisan. While the above description contains much specificity, these should not be construed as limitations on the scope of any embodiment, but as exemplifications of the presented embodiments thereof.

Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims.

Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Thus, the scope of the invention should be determined by the appended claims and their legal equivalents, and not by the examples given.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A visual barrier windscreen comprising:

a first series of monofilament threads formed in pillar stitches extending in a warp direction;

a second series of monofilament threads formed in zig-zag stitches extending in a first weft direction relative to the pillar stitches and binding adjacent pillar stitches; and a third series of monofilament threads formed in zig-zag stitches extending in a second weft direction opposite to the first weft direction and also binding adjacent pillar stitches;

wherein a pattern of hexagonal wind-passage holes are formed by a cooperation of the pillar stitches and zig-zag stitches;

wherein at least a 75-80% visual block is attained with the cooperation of the pillar stitches and zig-zag stitches;

wherein the first, the second, and the third series of monofilament threads comprise Ultraviolet (UV) stabilized high density polyethylene;

wherein the cooperation of the pillar stiches and zig-zag stitches achieve an air flow permeability that is greater than 755 cfm/ft$^2$; and wherein the visual barrier windscreen is configured to be installed on a fence.

2. The visual barrier windscreen according to claim 1, wherein the first, the second, and the third series of monofilament threads comprise UV stabilized high density polyethylene of approximately 450 denier each; and wherein the visual barrier windscreen has a weight of about 340 grams/m$^2$.

3. The visual barrier windscreen according to claim 1, wherein the first series of monofilament threats comprises UV stabilized high density polyethylene of approximately 750 denier; wherein the second and third series of monofilament threads comprise UV stabilized high density polyethylene of approximately 450 denier; and wherein the visual barrier windscreen has a weight of about 410 grams/m$^2$.

4. The visual barrier windscreen according to claim 1, wherein the first series of monofilament threads are formed in sixteen pillar stitches per inch.

5. The visual barrier windscreen according to claim 1, wherein the second and third series of monofilament threads are formed in closed zig-zag stitches extending across an equivalent of five needle gaps in the first and second weft directions respectively.

6. A visual barrier windscreen comprising:

a first series of monofilament threads formed in pillar stitches extending in a longitudinal direction;

a second series of monofilament threads formed in zig-zag stitches binding adjacent pillar stitches; and a third series of monofilament threads formed in zig-zag stitches binding adjacent pillar stitches;

wherein a pattern of wind-passage holes are formed by a cooperation of the pillar stitches and zig-zag stitches;

wherein at least one of the first, the second, and the third series of monofilament threads comprise Ultraviolet (UV) stabilized high density polyethylene of approximately 450 denier;

wherein the cooperation of the pillar stiches and zig-zag stitches achieve an air flow permeability that is greater than 755 cfm/ft$^2$;

wherein the first series of monofilament threads are formed in sixteen pillar stitches per inch;

wherein the visual barrier windscreen has at least a weight of about 340 grams/m$^2$; and wherein the visual barrier windscreen is configured to be installed on a fence.

7. The visual barrier windscreen according to claim 6, wherein at least one of the first, the second, and the third series of monofilament threads comprise high density polyethylene of approximately 750 denier; and wherein the visual barrier windscreen has a weight of about 410 grams/m$^2$.

8. The visual barrier windscreen according to claim 6, wherein the second and third series of monofilament threads are formed in closed zig-zag stitches extending across an equivalent of five needle gaps in the first and second weft directions respectively.

9. The visual barrier windscreen according to claim 6, wherein at least a 75-80% visual barrier is attained with the cooperation of the pillar stitches and zig-zag stitches.

10. The visual barrier windscreen according to claim 6, wherein the wind-passage holes comprise hexagonal wind passage holes formed by the cooperation of the pillar stitches and zig-zag stitches.

11. A method of making a visual barrier windscreen, the method comprising:

forming a first series of monofilament threads in pillar stitches extending in a longitudinal direction;

forming a second series of monofilament threads in zig-zag stitches binding adjacent pillar stitches; and forming a third series of monofilament threads in zig-zag stitches binding adjacent pillar stitches;

wherein a pattern of wind-passage holes are formed by a cooperation of the pillar stitches and zig-zag stitches;

wherein at least a 75-80% visual block is attained with the cooperation of the pillar stitches and zig-zag stitches;

wherein the first, the second, and the third series of monofilament threads comprise Ultraviolet (UV) stabilized high density polyethylene;

wherein the cooperation of the pillar stiches and zig-zag stitches achieve an air flow permeability that is greater than 755 cfm/ft$^2$.

12. The method according to claim 11, wherein the first series of monofilament threads are formed in pillar stitches extending in a warp direction, the second series of monofilament threads are formed in zig-zag stitches extending in a first weft direction relative to the pillar stitches, and the third series of monofilament threads are formed in zig-zag stitches extending in a second weft direction opposite to the first weft direction.

13. The method according to claim 11, wherein the first series of monofilament threads comprise UV stabilized high density polyethylene of approximately 750 denier; wherein the second and third series of monofilament threads comprise UV stabilized high density polyethylene of approximately 450 denier; and wherein the visual barrier windscreen has a weight of about 410 grams/m$^2$.

14. The method according to claim 11, wherein the first series of monofilament threads are formed in sixteen pillar stitches per inch.

15. The method according to claim 11, wherein the second and third series of monofilament threads are formed in closed zig-zag stitches extending across an equivalent of five needle gaps in the first and second weft directions respectively.

16. The method according to claim 11, wherein the first, the second, and the third series of monofilament threads comprise UV stabilized high density polyethylene of approximately 450 denier each; and wherein the visual barrier windscreen has a weight of about 340 grams/$m^2$.

17. The method according to claim 11, wherein the wind-passage holes comprise hexagonal wind passage holes formed by the cooperation of the pillar stitches and zig-zag stitches.

* * * * *